US005124618A

United States Patent [19]

Ohtaka et al.

[11] Patent Number: 5,124,618

[45] Date of Patent: Jun. 23, 1992

[54] SHATTER-PROOF FLUORESCENT LAMP

[75] Inventors: Yoshinori Ohtaka; Haruo Shibata, both of Takatsuki; Toyokazu Amano, Kyoto; Mutsuo Takahashi, Nagaokakyo; Shigeru Kamiya, Hirakata, all of Japan

[73] Assignee: Matsushita Electronics Corporation, Osaka, Japan

[21] Appl. No.: 612,311

[22] Filed: Nov. 13, 1990

[30] Foreign Application Priority Data

Nov. 16, 1989 [JP] Japan ..... 1-298261
Nov. 16, 1989 [JP] Japan ..... 1-298262

[51] Int. Cl.[5] ..... H01J 61/35; H01J 61/40; H01J 61/50; H01K 1/26

[52] U.S. Cl. ..... 313/489; 313/112; 313/493; 313/635; 313/312

[58] Field of Search ..... 313/489, 110, 111, 312, 313/493, 324, 112, 634, 635

[56] References Cited

U.S. PATENT DOCUMENTS

| | | | |
|---|---|---|---|
| 3,377,494 | 4/1968 | Repsher | 313/489 |
| 3,426,234 | 2/1969 | Hayasaka et al. | 313/312 |
| 3,602,759 | 8/1971 | Evans | 313/112 |
| 3,621,323 | 11/1971 | Thomas et al. | 313/312 |
| 3,748,518 | 7/1973 | Lewis | 313/635 |
| 4,332,329 | 6/1982 | Scriven et al. | 313/635 |
| 4,506,189 | 3/1985 | Nolan et al. | 313/493 |

FOREIGN PATENT DOCUMENTS

| | | | |
|---|---|---|---|
| 60-148043 | 8/1985 | Japan | 313/489 |
| 1-128347 | 11/1987 | Japan | 313/489 |
| 1-159959 | 12/1987 | Japan | 313/635 |
| 1-0311535 | 12/1989 | Japan | 313/312 |
| 2187037 | 8/1987 | United Kingdom | 313/312 |

OTHER PUBLICATIONS

Article: "Casting resins are here to stay as a method of housing components" from Electronics, Oct. 1956.

*Primary Examiner*—Donald J. Yusko
*Assistant Examiner*—John Giust
*Attorney, Agent, or Firm*—Ratner & Prestia

[57] ABSTRACT

A shatter-proof fluorescent lamp which includes a glass tube, electrodes connected to opposite terminal ends of the glass tube, a phosphor layer coated on the inside surface of the glass tube, a gaseous mixture containing mercury and rare gases confined in the glass tube, at least one ultraviolet ray absorbing layer capable of absorbing ultraviolet rays of 400 nm or less formed on the glass tube, and a transparent polymer resin layer formed on the ultraviolet ray absorbing layer.

2 Claims, 2 Drawing Sheets

SHATTER-PROOF FLUORESCENT LAMP

BACKGROUND OF THE INVENTION

1. Field of the Invention:

The present invention relates to a shatter-proof fluorescent lamp, and more particularly, to a shatter-proof fluorescent lamp having a glass tube coated with a layer whereby the glass tube is prevented from shattering to pieces when it is dropped or otherwise mishandled.

2. Description of the Prior Art

The fluorescent lamps are made of glass tubes which are fragile and easy to shatter when they are dropped or broken. In order to prevent the glass tube from shattering, the common practice is to envelop the glass tube with a transparent tube of polymer such as polyester of a thermo-contracting nature, which is heated so as to form a polymer tubular envelop. The glass tube of a lamp is enveloped with the tubular envelop by hand.

However, this method is costly because the process of forming polyester into tubular envelops involves complicated steps, and manual labor is required to envelop glass tubes of fluorescent lamps with the tubular envelops. Thus shatter-proof fluorescent lamps become more expensive than ordinary fluorescent lamps.

SUMMARY OF THE INVENTION

The shatter-proof fluorescent lamp of this invention, which overcomes the above-discussed problems and numerous other deficiencies of the prior art, comprises a glass tube, electrodes connected to opposite terminal ends of the glass tube, a phosphor layer coated on the inside surface of the glass tube, a gaseous mixture containing mercury and rare gases confined in the glass tube, a layer absorbing ultraviolet rays of 400 nm or less formed on the glass tube, and a transparent polymer resin layer formed on the ultraviolet rays absorbing layer.

According to another aspect of the present invention, the shatter-proof fluorescent lamp which comprises a glass tube, electrodes connected to opposite terminal ends of the glass tube, a phosphor layer coated on the inside surface of the glass tube, a gaseous mixture containing mercury and rare gases confined in the glass tube, a first layer absorbing ultraviolet rays of 400 nm or less formed on the glass tube, a transparent polymer resin layer formed on the ultraviolent ray absorbing layer, and a second layer absorbing ultraviolet rays of 400 nm or less formed on the transparent polymer resin layer.

In a preferred embodiment, the shatter-proof fluorescent lamp further comprises a second layer absorbing ultraviolet rays of 400 nm or less formed on the glass tube.

In a preferred embodiment, the ultraviolet rays absorbing layer is made of a zinc oxide film, and the transparent polymer resin layer is made of a polyurethane film. Thus, the invention described herein makes possible the objectives of (1) providing a shatter-proof fluorescent lamp capable of economical production, and (2) providing a shatter-proof fluorescent lamp capable of protecting the shatter-proof layer against deterioration due to ultraviolet rays.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
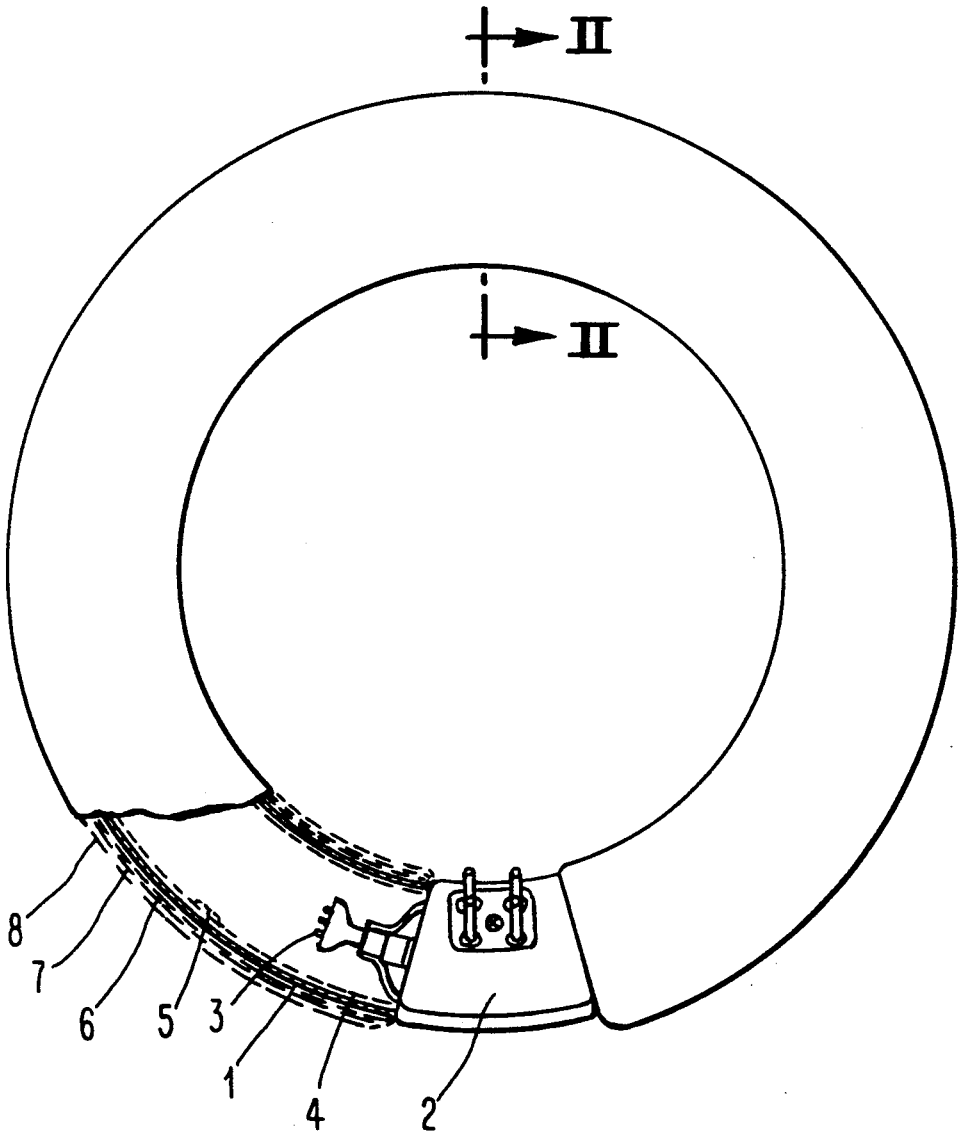
FIG. 1 is a partially cross-sectional view of a shatter-proof fluorescent lamp according to the present invention.
Figure 2:
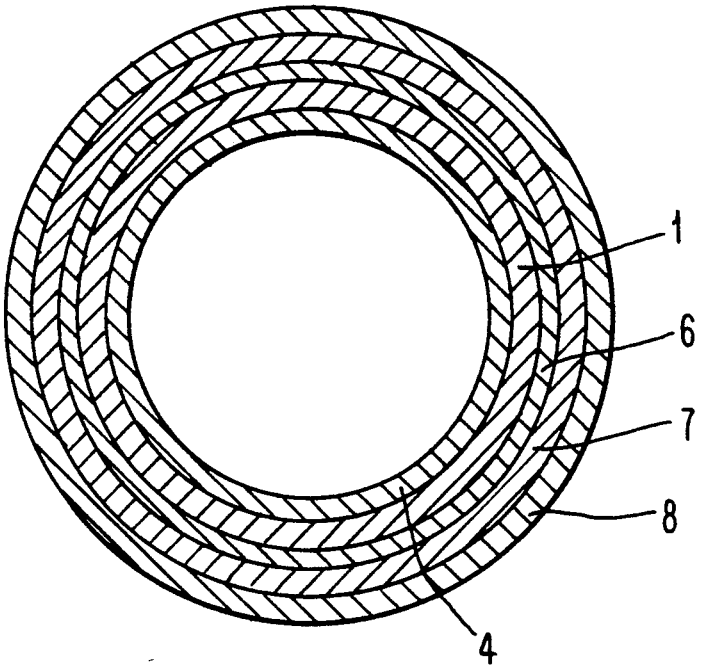
FIG. 2 is a cross-section taken along the line II—II in FIG. 1.

As shown in FIG. 1, the shatter-proof fluorescent lamp of the invention includes a ring-shaped glass tube 1 whose ends are coupled by a coupler 2. The reference numeral 3 designates electrodes connected to the respective terminal ends of the glass tube 1. The glass tube 1 is lined with a layer 4 of a fluorescent substance, and filled with a gaseous mixture of mercury 5 and rare gases such as argon. As also can be seen in FIG. 2., the outside surface of the glass tube 1 is covered with a plurality of film layers, that is, from inside to outside, a first ultraviolet ray absorbing layer 6 such as a zinc oxide film, capable of absorbing ultraviolet rays of 400 nm or less, and a transparent polymer layer 7, such as polyurethane. Hereinafter, this glass tube will be referred to as "Type (1) glass tube". Preferably a second ultraviolet ray absorbing layer 8, such as a zinc oxide film, can be provided. The second ultraviolet ray absorbing layer 8 also absorbs ultraviolet rays of 400 nm or less. This glass tube having the two ultraviolet ray absorbing layers 6 and 8 will be referred to as "Type (2) glass tube".

Thus the ultraviolet ray absorbing layer absorbs ultraviolet rays of 400 nm or less irradiating from the fluorescent lamp. In the fluorescent lamp having a Type (2) glass tube, the second ultraviolet ray absorbing layer 8 absorbs another shot of ultraviolet rays of 400 nm or less from outside the lamp. In the Type (2) the internal and external ultraviolet rays are absorbed by the two ultraviolet ray absorbing layers 6 and 8, thereby preventing the transparent polymer layer 7 from being exposed to ultraviolet rays. Generally speaking, polymer is liable to deterioration by ultraviolet rays, but the ultraviolet ray absorbing layers 6 and 8 protect the polymer layer 7 against ultraviolet rays.

The polymer layer can be coated on the outside surface of the glass tube 1 easily and economically, that is, with the use of reduced labor and shatter-proof fluorescent lamp of the present invention is reduced by about one-half as compared with the known shatter-proof fluorescent lamps wrapped in a polyester tube.

The formation of the multilayers will now be described:

After an ordinary circular fluorescent lamp (30 W) is submerged at its horizontal posture in a solution containing zinc oxide dissolved in an organic solvent, the lamp is dried by hot air having a temperature 70° C. at a velocity of 5.0 m/sec. In this way a transparent ultraviolet ray absorbing film is formed to a thickness of 10 μm. Then, the fluorescent lamp is submerged at its horizontal posture in an aqueous solution of 1500 gr containing polyurethane in dispersion. The lamp is dried by hot air at a temperature of 100° C. at a velocity of 5.0 m/sec. In this way a transparent film is formed to a thickness of 80 μm. When the second ultraviolet ray absorbing layer 8 is overlaid, it is formed by the same method as that applied to the first ultraviolet ray absorbing layer 6.

The fluorescent lamp obtained in this way was tested to see how it shattered when it was dropped onto a hard floor. The lamp was dropped at its horizontal posture from a point 3.0 m high. The glass tube 1 cracked, but the cracking glass was prevented from scattering because of the adherence of the broken pieces to the polymer layers. Another test was conducted by striking a steel ball of 200 gr suspended on a string of 1.0 m long against the lamp at 30° to a vertical line. No damage or crack occurred to the layers.

Tests were also conducted to see how long the shatter-proof fluorescent lamp of the invention would endure use, by allowing the lamp to continue to burn for 7000 hours for the Type (1) glass tube and for 5000 hours for the Type (2) glass tube. The two tests revealed that such long continuous uses caused no change to the brightness of the lamp; for example, no yellowish coloring was found on the polymer layer.

The known fluorescent lamps having only a polymer layer on its outside surface was likewise tested and found as follows:

Free radicals were produced from the polymer by exposure to ultraviolet rays of 400 nm or less from the fluorescent lamp, and as this reaction proceeds, the polymer chains were broken one after another, thereby reducing the tensile strength and elongation percentage. In addition, the polymer film was yellowish after 1000 hours of burning. The faded color spoils the appearance of the lamp, and reduces the luminance efficiency.

The illustrated example is a circular shatter-proof fluorescent lamp but the present invention can be applied to any other type of fluorescent lamp such as a bar-like straight fluorescent lamp, a U-shaped fluorescent lamp, and a combination of two bar-like straight lamps.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A shatter-proof fluorescent lamp which comprises a glass tube, electrodes connected to opposite terminal ends of the glass tube, a phosphor layer coated on the inside surface of the glass tube, a gaseous mixture containing mercury and rare gases confined in the glass tube, a first layer absorbing ultraviolet rays of 400 nm or less formed on the glass tube, wherein the first ultraviolet ray absorbing layer is formed by submerging the tube in an aqueous solution containing zinc oxide dissolved in an organic solvent, a transparent polymer resin layer formed on the first ultraviolet ray absorbing layer, and a second layer absorbing ultraviolet rays of 400 nm or less formed on the transparent polymer resin layer, wherein the second ultraviolet ray absorbing layer is formed by submerging the tube in an aqueous solution containing zinc oxide dissolved in an organic solvent.

2. A shatter-proof fluorescent lamp according to claim 1, wherein the transparent layer is made of a polyurethane film.

* * * * *